US010184259B2

(12) United States Patent
Fränkel

(10) Patent No.: US 10,184,259 B2
(45) Date of Patent: Jan. 22, 2019

(54) UNDERWATER CLEANER

(71) Applicant: Andrés Fränkel, Perchtoldsdorf (AT)

(72) Inventor: Andrés Fränkel, Perchtoldsdorf (AT)

( * ) Notice: Subject to any disclaimer, the term of this patent is extended or adjusted under 35 U.S.C. 154(b) by 319 days.

(21) Appl. No.: 15/257,344

(22) Filed: Sep. 6, 2016

(65) Prior Publication Data

US 2017/0073989 A1 Mar. 16, 2017

(30) Foreign Application Priority Data

Sep. 10, 2015 (AT) ..... A 50778/2015

(51) Int. Cl.
*E04H 4/16* (2006.01)
*B63B 59/08* (2006.01)

(52) U.S. Cl.
CPC ..... *E04H 4/1654* (2013.01); *B63B 59/08* (2013.01); *E04H 4/1618* (2013.01); *E04H 4/1636* (2013.01); *B63B 2059/082* (2013.01)

(58) Field of Classification Search
CPC ... E04H 4/1654; E04H 4/1618; E04H 4/1636; B63B 59/08; B63B 2059/082
USPC ..... 15/1.7
See application file for complete search history.

(56) References Cited

U.S. PATENT DOCUMENTS 8,397,331 B2 3/2013 Pichon et al.
2001/0032809 A1 10/2001 Henkin et al.
2005/0247613 A1 11/2005 Bishop et al.
2010/0139017 A1* 6/2010 Stoltz ..... E04H 4/1663 15/1.7
2013/0081656 A1* 4/2013 Gopalan ..... A47L 9/1427 134/21
2015/0128361 A1* 5/2015 Erlich ..... E04H 4/1636 15/1.7
2016/0237709 A1* 8/2016 Dietrich ..... E04H 4/1636

FOREIGN PATENT DOCUMENTS

WO 2014173937 10/2014

* cited by examiner

*Primary Examiner* — Weilun Lo
(74) *Attorney, Agent, or Firm* — Dykema Gossett PLLC

(57) ABSTRACT

The invention relates to an underwater cleaner (1), especially for a swimming pool, comprising a housing (2) in which an especially battery-powered pump having an electric motor (4) and an impeller (3) is arranged, wherein the housing (2) comprises an inlet opening (23) and an outlet opening (22) for a flow path, said flow path forming a first channel section (13) originating from the first inlet opening (23) and a second channel section (14) accommodating the impeller (3), wherein the second channel section (14) is arranged in an inclined manner in relation to the first channel section (13), and wherein the impeller axis (18) is arranged in an inclined manner in relation to a normal (24) to the opening cross-section of the inlet opening (23). The ratio A/B of a first cross-sectional surface A to a second cross-sectional surface B is less than 2.8, wherein the first cross-sectional surface A is defined by the smallest flow cross-section in the first channel section (13) and the second cross-sectional surface B by the smallest flow cross-section of the second channel section (14) directly at the pump inlet. In order to obtain the simplest possible underwater cleaner (1) with the lowest production costs, which offers high suction power with low flow losses even in the case of impellers (3) of relatively large diameters, the first channel section (13) converges continuously into the second channel section (14).

16 Claims, 4 Drawing Sheets

UNDERWATER CLEANER

The invention relates to an underwater cleaner, especially for a swimming pool, comprising a housing in which an especially battery-powered pump having an electric motor and an impeller is arranged, wherein the housing comprises an inlet opening and an outlet opening for a flow path, said flow path forming a first channel section originating from the first inlet opening and a second channel section accommodating the impeller, wherein the second channel section is arranged in an inclined manner in relation to the first channel section, and the impeller axis is arranged in an inclined manner in relation to a normal to the opening cross-section of the inlet opening, and wherein the ratio A/B of a first cross-sectional surface A to a second cross-sectional surface B is less than 2.8, wherein the first cross-sectional surface A is defined by the smallest flow cross-section in the first channel section and the second cross-sectional surface B by the smallest flow cross-section of the second channel section directly at the impeller inlet.

US 2005/0247613 A1 discloses an underwater vacuum cleaner, in which the rotational axis of the impeller is arranged in an inclined manner in relation to a normal to an inlet cross-sectional surface. A first channel section with a tapering cross-section is arranged adjacent to the inlet opening of the underwater vacuum cleaner, which first channel section opens into a suction chamber in which a dirt filter is arranged. A second channel section originates from said suction chamber in which a pump with a radial impeller is arranged. The inlet cross-section into the pump is dimensioned to be relatively small. As a result of various deflections and sharp edges, swirling occurs especially after the first channel section, which limits the suction power.

An underwater cleaner is known from WO 2014/173937 A1 in which the impeller axis is arranged normally to the opening cross-section of the inlet opening. The impeller, which is formed as an axial impeller, is arranged close to the bottom, directly in the region of the inlet opening of the underwater cleaner. A stagnation zone with low flow velocities in which the cleaning effect is reduced can especially be formed beneath the impeller axis when using axial impellers of large diameters. The increase in the suction power by increasing the impeller diameter is thus subject to certain limits.

An underwater cleaner is known from U.S. Pat. No. 8,397,331 B2, which comprises a first channel section originating from an inlet opening and a second channel section accommodating an impeller, wherein the second channel section is arranged in an inclined manner in relation to the first channel section and the impeller axis is arranged in relation to a normal to the opening cross-section of the inlet opening. The ratio of the smallest first cross-sectional surface of the first channel section to the smallest cross-sectional surface of the second channel section is less than 2.8. An internal dirt collection chamber is formed between the first channel section and the second channel section, wherein the flow cross-sections change abruptly in the region of the orifice of the first channel section into the dirt collection chamber and in the region of the outlet from the dirt collection chamber into the second channel section, which leads to swirling and relatively high flow losses. It is a further disadvantage of the internal dirt collection chamber that the filling level cannot be seen from the outside and the housing needs to be opened for emptying the dirt collection chamber. A similar underwater cleaner is known from US 2001/0032809 A1.

It is the object of the invention to develop an underwater vacuum cleaner which is formed in the simplest possible way, is easy to produce and offers a high suction effect, especially also when using impellers of relatively large diameters.

This is achieved in accordance with the invention in such a way that the first channel section converges continuously into the second channel section.

This possible because the dirt is collected in the dirt filter arranged on the pressure side of the impeller in the region of the outlet opening of the second channel section outside of the housing. It is thus possible to omit an internal dirt collection chamber which would lead to flow losses. Swirling and flow losses can thus be avoided.

Optimal results can be achieved when the ratio A/B is equal to or less than 0.5.

In a preferred embodiment of the underwater cleaner, the impeller is formed as an axial impeller, which leads to the advantage that relatively high flow rates and therefore an especially high suction power can be achieved.

In a further preferred embodiment, the outlet opening is formed by a second channel section. This leads to the advantage that the arrangement is compact.

An embodiment is advantageous in this case in which a receiver for a dirt filter is arranged in the region of the outlet opening, because a simple, compact and cost-effective configuration is thus achieved. A further advantage is achieved in that by arranging the filter on the pressure side the suction will not lead to any problems when the filter is blocked. Furthermore, the disadvantage of a filter on the suction side can be avoided in that dirt particles drop out of the underwater cleaner again when the suction element is removed from the pool and the underwater cleaner is placed on the ground. Furthermore, coarse dirt can be crushed by the impeller, which leads to a further advantage.

In order to produce the lowest possible level of losses by swirling and detached particles, the second channel section is formed as a cylindrical tube as a further preferred embodiment. This configuration can further be produced at low cost.

The angle between the central flow axis of the first channel section and the central flow axis of the second channel section preferably encloses an angle of 30° to 90°, wherein an embodiment is especially preferred in which this angle is between 70° and 80°. As a result of this arrangement, the region in which large dirt particles can also be sucked in can be extended over the entire region which is covered from the initial region of the first channel section. This is not possible in the case of underwater cleaners in which the impeller axis is arranged normally to the opening cross-section of the inlet opening. Reduced velocities occur in these cleaners close to the impeller axis and therefore a region occurs in which the cleaning effect is locally reduced.

In order to reduce the size of the underwater cleaner even further, the impeller is arranged directly at the beginning of the second channel section in a preferred embodiment.

The underwater cleaner is preferably further formed in such a way that the initial region of the second channel section is directly adjacent to the end region of the first channel section, which is advantageous for the most uncomplicated solution with few detachments and the thus resulting losses.

In a further preferred embodiment, the first channel section has a rectangular or oval cross-section which preferably tapers from the initial region of the first channel section to the end region of the first channel section. This embodiment offers the advantage during the cleaning of swimming pool that corners and steps can also be cleaned more easily.

An embodiment is further advantageous in which a gear is arranged between the electric motor and the impeller and the ratio between the speed of the electric motor and the speed of the impeller is greater than 1. The installation of a high-speed compact motor can be provided by this embodiment. A motor of lower power can thus be used, which allows a suction power which is greater from a relative standpoint.

The invention will be explained below in closer detail by reference to the non-limiting drawings, wherein.

Figure 2:
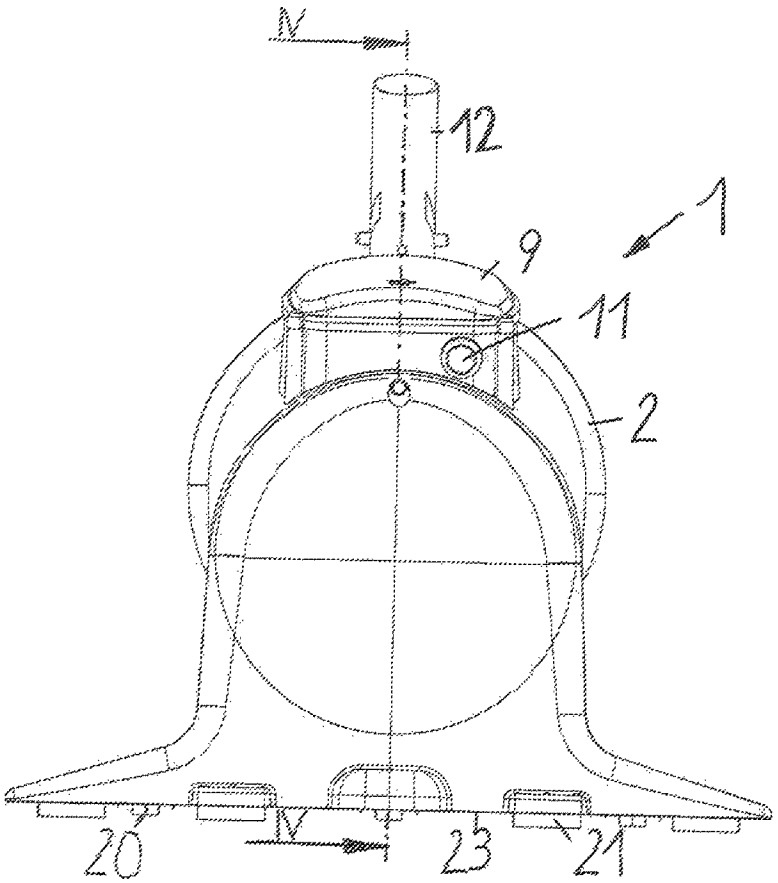
FIG. 2 shows the underwater cleaner in a front view.
Figure 1:
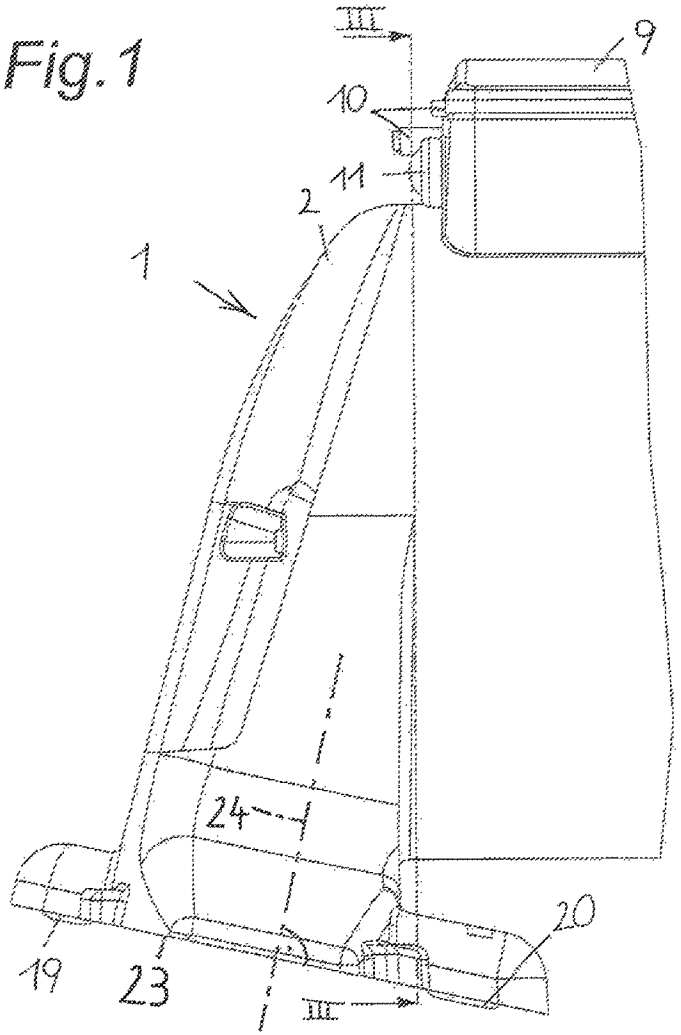
FIG. 1 shows a side view of an underwater cleaner in accordance with the invention.
Figure 4:
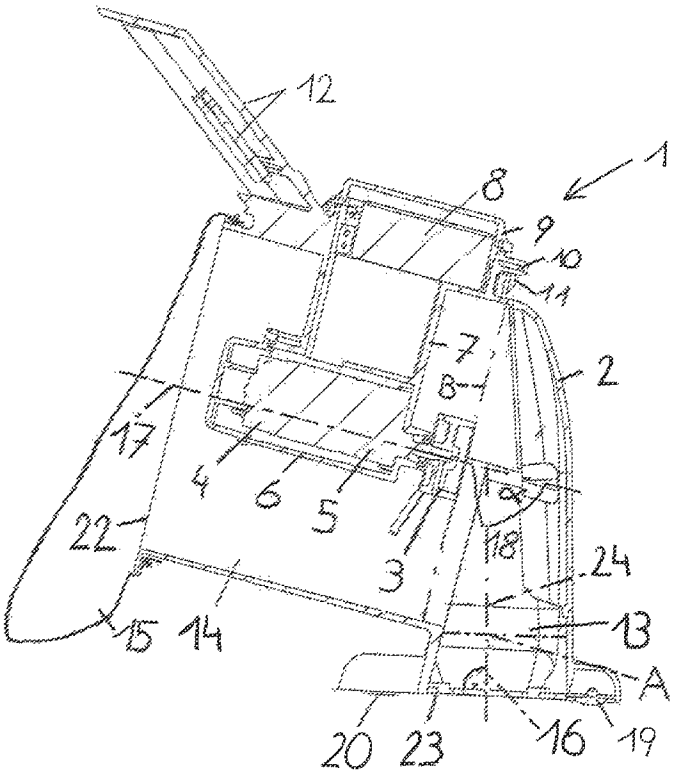
FIG. 4 shows the underwater cleaner in a sectional view along the line IV-IV in FIG. 2.
Figure 3:
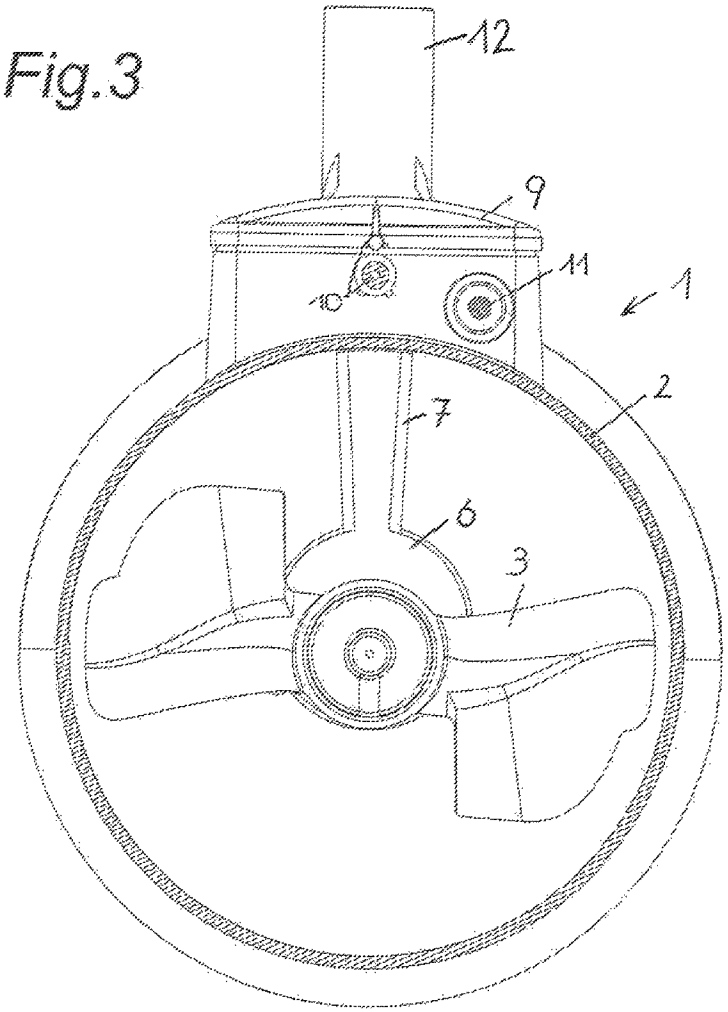
FIG. 3 shows the underwater cleaner in a sectional view along the line III-III in FIG. 1.
Figure 6:
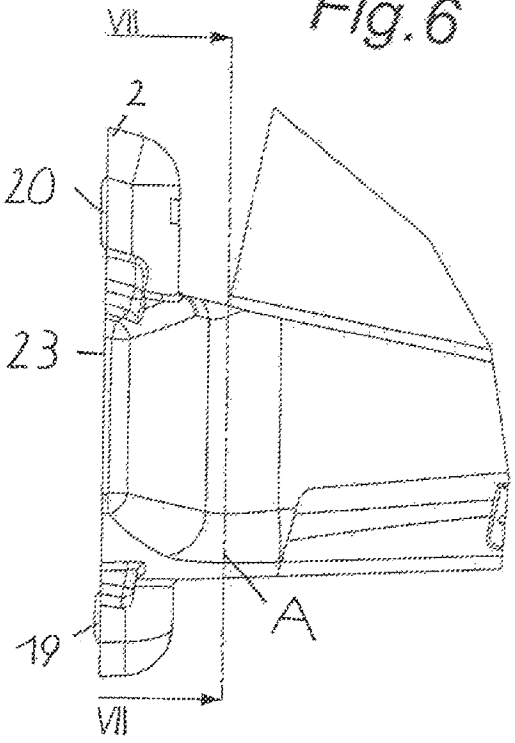
FIG. 6 shows the underwater cleaner in a side view.
Figure 5:
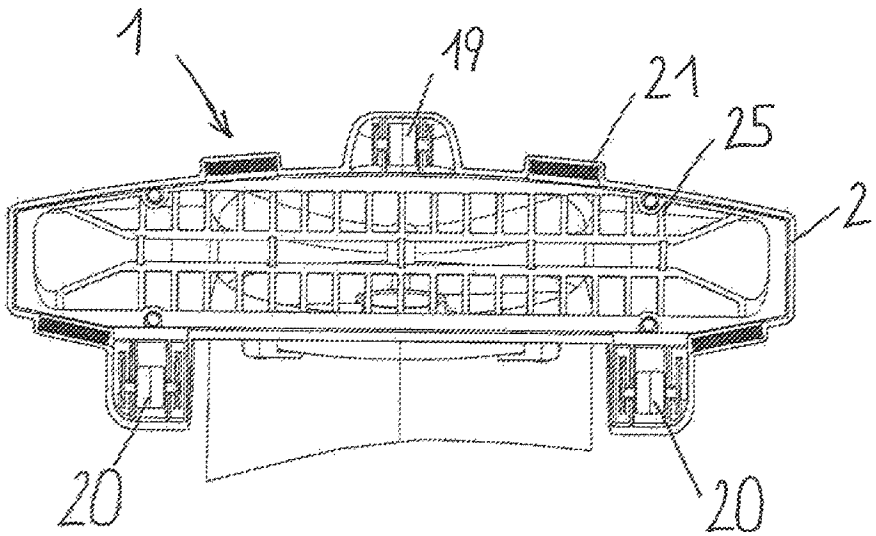
FIG. 5 shows the underwater cleaner in a view from the inlet side.
Figure 7:
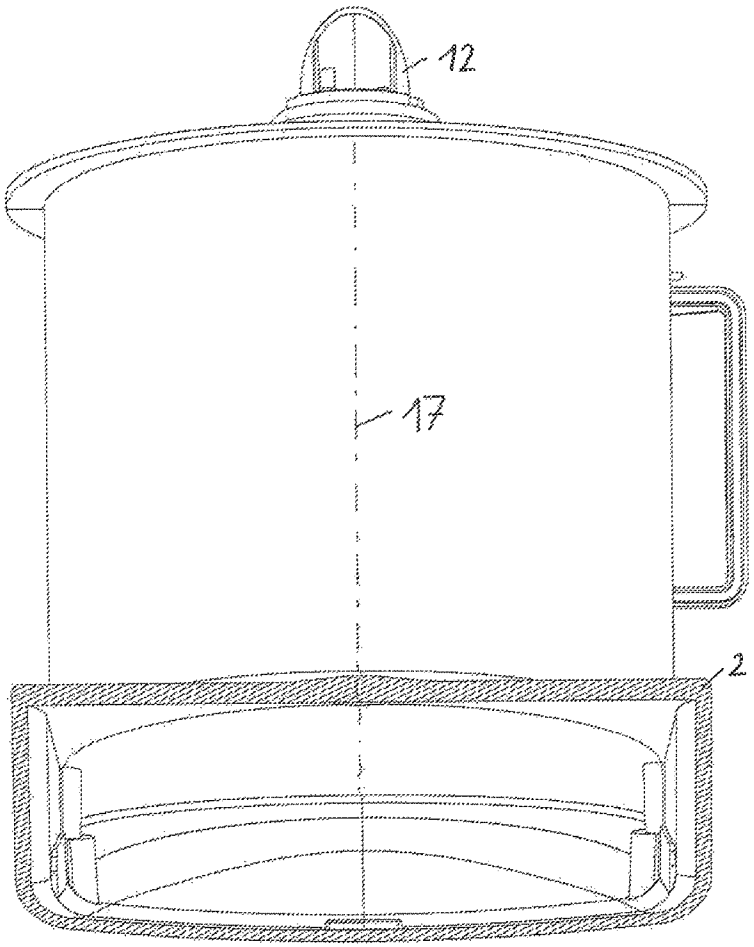
FIG. 7 shows the underwater cleaner in a sectional view along the line VII-VII in FIG. 6.

The underwater cleaner 1 which is shown in the drawing and provided for a swimming pool for example comprises a housing 2 in which an impeller 3 operates having an electric motor 4 and a gear 5 as a pump. The impeller 3 is driven by the electric motor 4 via the gear 5. The electric motor 4 and the gear 5 and the mounting of the impeller 3 are housed in a pump housing 6. The pump housing 6 is connected to the housing 2 via a suspension 7. Rechargeable batteries 8 are arranged for example above the suspension 7 on the upper side of the housing 2. The batteries 8 are arranged in a waterproof manner, sealed in the housing 2 by a battery housing cover 9. A closure 10 for the battery housing cover 9 is attached to the housing 2. The suspension 7 is formed in a hollow manner in order to house the electric connection between the electric motor 4 and the batteries 8 in said suspension. A switch 11 is located outside on the housing 2 adjacent to the closure 10, via which the power supply of the electric motor 4 can be actuated. According to a further alternative variant (not shown in closer detail), the batteries 8 are arranged directly on or in the pump housing 6.

In the illustrated embodiment, the impeller 3 is formed as an axial impeller.

In order to enable the movement of the underwater cleaner 1 on the bottom of the swimming pool, a rod (not shown in closer detail) can be mounted on the device. Said rod is connected to a rod receiver 12. The rod receiver 12 is located on the top side of the housing 2 behind the batteries 8. In the illustrated embodiment, the rod receiver 12 is rigidly connected to the housing 2. The rod receiver 12 can also be pivotably arranged with respect to the housing 2.

The housing 2 comprises a first channel section 13 and a second channel section 14. The impeller 3 and the pump housing 6 with the electric motor 4 and the gear 5 are disposed in the second channel section 14. In the illustrated embodiment, the second channel section 14 has the shape of a cylindrical tube, wherein the first channel section 13 converges directly into the second channel section 14.

A dirt filter 15 is attached on the pressure side to the outlet opening 22 of the second channel section 14. In the illustrated embodiment, the impeller 3 comprises two impeller blades, by means of which leaves and other dirt can be removed easily from the surface of the swimming pool and can be conveyed into the dirt filter 15.

The inlet opening 23 is situated on the bottom side of the underwater cleaner 1 facing the surface to be cleaned. The normal 24 stands normally to the plane defined by the inlet opening 23 and is disposed parallel to the central flow axis 16 of the first channel section 13.

The central flow axis 16 of the first channel section 13 and the impeller axis 18 enclose an angle $\alpha$ von 70° to 80° in the illustrated embodiment. The impeller axis 18 coincides in this embodiment with the central flow axis 17 of the second channel section 14.

A first cross-sectional surface A, which is defined by the smallest flow cross-section in the first channel section 13, is especially outlined in the first channel section 13, as also a second cross-sectional surface B of the second channel section 14 in the region of the inlet into the impeller 3. The ratio of the first cross-sectional surface A to the second cross-sectional surface B is less than 0.5 in the illustrated embodiment.

The flow cross-section is strongly broadened in the region of the inlet opening 23 of the first channel section 13 in order to allow the suction effect to act on the largest possible surface area. The cross-sections along the central flow axis 16 of the first channel section 13 to the impeller 3 then decrease continuously up to the first cross-sectional surface A, as shown in FIG. 2. A roller 19 is attached to the front side of the housing 2 at the inlet of the first channel section 13. One larger roller 20 each is attached to the rear side of the housing 2 at the inlet of the first channel section 13 to the left and right of the central flow axis 16 of the first channel section 13. These three rollers are used to ensure sufficient distance from the bottom, so that the underwater cleaner 1 is not tightly sucked to the bottom of the swimming pool and thus further movement remains possible. Brushes 21 are arranged around the inlet opening 23 of the first channel section 13. Brushes 21 are attached at four points in this embodiment in order to achieve a better cleaning effect.

The illustrated embodiment comprises a protective grating 25 at the inlet opening 23 in order to prevent reaching inside into the impeller 3. Injuries can thus be avoided.

The invention claimed is:

1. An underwater cleaner for a swimming pool, comprising a housing in which an pump having an electric motor and an impeller is arranged, wherein the housing comprises an inlet opening and an outlet opening for a flow path, said flow path forming a first channel section originating from the first inlet opening and a second channel section accommodating the impeller, wherein the second channel section is arranged in an inclined manner in relation to the first channel section, and the impeller axis is arranged in an inclined manner in relation to a normal to the opening cross-section of the inlet opening, and wherein the ratio A/B of a first cross-sectional surface A to a second cross-sectional surface B is less than 2.8, wherein the first cross-sectional surface A is defined by the smallest flow cross-section in the first channel section and the second cross-sectional surface B by the smallest flow cross-section of the second channel section directly at the impeller inlet, wherein the first channel section converges continuously into the second channel section.

2. The underwater cleaner according to claim 1, wherein the ratio A/B of the first cross-sectional surface A to the second cross-sectional surface B is less than 2.

3. The underwater cleaner according to claim 1, wherein the ratio A/B of the first cross-sectional surface A to the second cross-sectional surface B is less than 1.

4. The underwater cleaner according to claim 1, wherein the impeller is formed as an axial impeller.

5. The underwater cleaner according to claim 1, wherein the second channel section forms the outlet opening.

6. The underwater cleaner according to claim 1, wherein a receiver for a dirt filter is arranged in the region of the outlet opening.

7. The underwater cleaner according to claim 1, wherein the second channel section is formed by a tube.

8. The underwater cleaner according to claim 7, wherein the second channel section is formed by a cylindrical tube.

9. The underwater cleaner according to claim 1, wherein a central flow axis of the first channel section forms an angle of between 30° and 90° in the region of the inlet opening with the impeller axis and/or with a central flow axis of the second channel section.

10. The underwater cleaner according to claim 1, wherein the impeller is arranged directly at the beginning of the second channel section.

11. The underwater cleaner according to claim 1, wherein the initial region of the second channel section directly adjoins the end region of the first channel section.

12. The underwater cleaner according to claim 1, wherein the first channel section substantially has a rectangular or oval cross-section.

13. The underwater cleaner according to claim 12, wherein the cross-section tapers between an initial region and an end region of the first channel section.

14. The underwater cleaner according to claim 1, wherein the electric motor acts on the impeller via a gear, so that the ratio between the speed of the electric motor and the speed of the impeller is greater than 1.

15. The underwater cleaner according to claim 1, wherein the pump is battery-powered.

16. The underwater cleaner according to claim 1, wherein the central flow axis of the first channel section forms an angle of between 70° and 80° in the region of the inlet opening with the impeller axis and/or with a central flow axis of the second channel section.

* * * * *